US007277105B2

(12) United States Patent
Abe et al.

(10) Patent No.: US 7,277,105 B2
(45) Date of Patent: Oct. 2, 2007

(54) DRIVE CONTROL APPARATUS AND METHOD FOR MATRIX PANEL

(75) Inventors: Naoto Abe, Tokyo (JP); Katsunori Hatanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 660 days.

(21) Appl. No.: 10/747,266

(22) Filed: Dec. 30, 2003

(65) Prior Publication Data

US 2004/0150660 A1 Aug. 5, 2004

(30) Foreign Application Priority Data

Jan. 9, 2003 (JP) ..... 2003-002969

(51) Int. Cl.
*G09G 5/10* (2006.01)

(52) U.S. Cl. ..... 345/691; 345/690

(58) Field of Classification Search ..... 345/204, 345/690, 691, 89, 95
See application file for complete search history.

(56) References Cited

U.S. PATENT DOCUMENTS

| | | | | |
|---|---|---|---|---|
| 5,510,858 | A | 4/1996 | Shido et al. | 348/718 |
| 5,555,000 | A | 9/1996 | Sarrasin et al. | 345/75 |
| 5,801,671 | A * | 9/1998 | Kobayashi et al. | 345/95 |
| 6,081,303 | A | 6/2000 | Kim | 348/797 |
| 6,236,385 | B1 * | 5/2001 | Nomura et al. | 345/95 |
| 6,549,187 | B1 * | 4/2003 | Matsubara et al. | 345/96 |
| 6,741,291 | B1 * | 5/2004 | Tsubaki | 348/533 |
| 6,745,357 | B2 * | 6/2004 | Chrudimsky et al. | 714/726 |
| 6,940,934 | B2 * | 9/2005 | Suzuki et al. | 375/354 |
| 6,985,141 | B2 * | 1/2006 | Abe et al. | 345/204 |
| 7,106,288 | B2 * | 9/2006 | Shen et al. | 345/89 |
| 2001/0011987 | A1 | 8/2001 | Kubota et al. | 345/98 |
| 2002/0033886 | A1 | 3/2002 | Hatanaka | 348/211 |
| 2003/0030654 | A1 | 2/2003 | Sagano et al. | 345/660 |
| 2003/0063077 | A1 | 4/2003 | Koyama | 345/204 |
| 2005/0231498 | A1 * | 10/2005 | Abe et al. | 345/204 |

FOREIGN PATENT DOCUMENTS

| | | |
|---|---|---|
| EP | 936596 A1 * | 6/1999 |
| JP | 7-177446 | 7/1995 |
| JP | 7-181917 | 7/1995 |
| JP | 10-39825 | 2/1998 |
| JP | 2002-221932 | 8/2002 |

OTHER PUBLICATIONS

Patent Abstracts of Japan, vol. 1995, No. 10, Nov. 30, 1995 (JP-A 7-177446, Jul. 14, 1995).
May 2, 2006 European Search Report in European Patent Appln. No. 04000150.

* cited by examiner

*Primary Examiner*—Ricardo Osorio
(74) *Attorney, Agent, or Firm*—Fitzpatrick, Cella, Harper & Scinto

(57) ABSTRACT

A matrix panel drive control apparatus having improved display peak luminance and reduced black level luminance, permitting further improved contrast, includes a row selection circuit for selecting at least one row from among a plurality of rows of the matrix panel, a column drive circuit for supplying a modulation signal based on pixel data to a plurality of columns of the matrix panel, a clock signal supplying circuit for supplying a reference clock signal for controlling at least the pulse width of the modulation signal to the column drive circuit, and a control circuit for setting the length of the selection period and the cycle of the reference clock signal for each selected row on the basis of the pixel data. The control circuit carries out control so as to extend the cycle of the reference clock signal for a selected row having a longer selection period.

8 Claims, 13 Drawing Sheets

DRIVE CONTROL APPARATUS AND METHOD FOR MATRIX PANEL

BACKGROUND OF THE INVENTION

1. Field of the Invention

The present invention relates to a drive control apparatus and a drive control method for a matrix panel used with a display unit to display television image signals or computer output image signals, or with an electron source or the like that emits electrons.

2. Description of the Related Art

An image display apparatus using electron beams will be described as an example of a matrix panel implementing the present invention.

This type of image display apparatus conventionally has been known to have a multi-electron source for a matrix panel. The matrix panel includes a total of N×M cold cathode devices (image display devices) with N cold cathode devices arranged in the direction of rows and M cold cathode devices arranged in the direction of columns. These cold cathode devices are two-dimensionally arranged in a matrix pattern, and connected in a simple matrix wiring by M row wires (scanning wires) provided in the direction of rows and N column wires (modulation wires) provided in the direction of columns.

According to a typical method for driving a number of matrix-wired cold cathode devices, for each row of the matrix the devices in the row are simultaneously driven, with each of the devices of the each row being connected to a single row wire.

More specifically, a predetermined selection voltage selectively is applied to a single row wire, and a predetermined modulation voltage selectively is applied only to the column wire connected to the particular cold cathode device to be driven among the N cold cathode devices connected to that single row wire. Thus, a plurality of devices of one row simultaneously are driven by the potential difference between the potential of the row wire and the potential of the respective column wires. The row wires selectively are changed in sequence so as to scan all rows, thereby to form a two-dimensional image, making use of visual afterimages.

This method advantageously extends the drive time allocated to each device by N-fold, thus permitting higher brightness of an image display apparatus to be achieved, as compared with the method in which devices are scanned one-by-one.

This drive method presents a problem with respect to higher black level luminance. In other words, the black level is brighter, leading to a deteriorated contrast. As a solution to this problem, a method has been proposed in Japanese Unexamined Patent Application Publication No. 2002-221932, in which scanned wire drive time is controlled so as to lower the black level luminance, thereby to improve the contrast.

In the drive method described above, it is possible to control the scanned wire drive time in a predetermined horizontal scanning period by sequentially driving the scanned wires, thereby to reduce the black level luminance, which is an important factor in image quality. It is difficult, however, to improve display peak luminance, which is another important factor affecting image quality.

SUMMARY OF THE INVENTION

It is an object of the present invention to provide a drive control apparatus and a drive control method for a matrix panel that allows display peak luminance to be improved.

It is another object of the present invention to provide a drive control apparatus and a drive control method for a matrix panel that allows black level luminance to be reduced so as to further improve contrast.

To this end, according to one aspect of the present invention, a matrix panel drive control apparatus includes a row selection circuit for selecting at least one row from among a plurality of rows of the matrix panel during a selection period, a column drive circuit for supplying a modulation signal based on pixel data to a plurality of columns of the matrix panel in synchronization with the selection period, a clock signal supplying circuit for supplying a reference clock signal used for controlling at least the pulse width of the modulation signal to the column drive circuit, and a control circuit for setting the length of the selection period and the cycle of the reference clock signal for each selected row on the basis of the pixel data, wherein the control circuit carries out control so as to extend the cycle of the reference clock signal for a selected row having a longer selection period.

With this arrangement, display peak luminance can be improved and black level luminance can be reduced, permitting further improved contrast to be achieved.

According to another aspect of the present invention, a drive control method for a matrix panel includes a row selection step for selecting at least one row from among a plurality of rows of a matrix panel during a selection period, a column drive step for supplying a modulation signal based on pixel data to a plurality of columns of the matrix panel in synchronization with the selection period, a clock signal supplying step for supplying a reference clock signal for controlling at least a pulse width of the modulation signal to the column drive circuit, and a setting step for setting a length of the selection period and the cycle of the reference clock signal for each selected row on the basis of the pixel data, wherein the setting step allocates a longer cycle of the reference clock signal to a selected row having a longer selection period.

With this arrangement, image display with higher contrast can be achieved.

Preferably, the matrix panel drive control apparatus has a power circuit for supplying at least three levels of modulation reference voltages that can be selected according to the pixel data to the column drive circuit, and has a period wherein pulse width modulation based on the reference voltage for first modulation is performed in a first modulation range, and pulse width modulation based on the reference voltage for second modulation, which is higher than the reference voltage for the first modulation, is performed in a second modulation range having a higher luminance level.

Preferably, the selection period and the cycle of the reference clock signal are selected in a variable range for each selected row on the basis of the maximum value of the pixel data.

Preferably, the drive control apparatus for a matrix has a compensating circuit for carrying out signal processing to compensate for deviation of the luminance of a pixel from a desired value in a selection period on the basis of the length of the selection period and/or the cycle of the reference clock signal.

Preferably, if the number of unit waveforms that depends on the maximum value of the pixel data for each selected row is denoted by Mh, the total number of the Mh's over a plurality of selection periods is denoted by Mf, the total number of displayable unit waveforms over the plurality of selection periods is denoted by Mfx, and the multiplication coefficient for multiplying the pixel data therewith, as necessary, is denoted by GAIN, then the GAIN is determined by Mfx/Mf.

Further objects, features and advantages of the present invention will become apparent from the following description of the preferred embodiments with reference to the attached drawings.

DESCRIPTION OF THE PREFERRED EMBODIMENTS

First Embodiment

Referring to FIGS. 1A, 1B and 2 to FIG. 5, preferred embodiments of the present invention will be explained.

Before describing major characteristics of the first embodiment shown in FIG. 1B, the basic operation of the drive method for a matrix panel will be explained.

Figure 2:
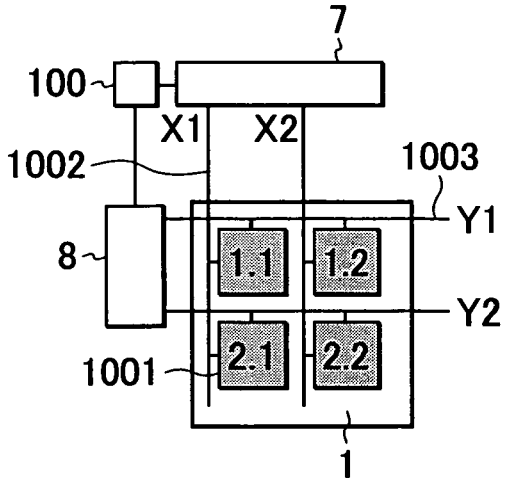
FIG. 2 is a block diagram showing a matrix panel drive control apparatus according to the present invention.

FIG. 2 shows a matrix panel having matrix wires for two rows and two columns for purposes of explaining the basic operation.

Reference numeral 1 denotes a matrix panel. A pixel 1001 composed of a cold cathode device is formed on a substrate made of glass or the like. A display matrix panel using cold cathode devices has a substrate made of glass or the like opposing the pixel 1001, a fluorescent material (not shown) having been applied thereto, and a high voltage being applied to the opposing substrate. The fluorescent material emits light when subjected to electrons discharged from the cold cathode devices.

Reference numeral 1002 denotes column wires and reference numeral 1003 denotes row wires. The physical intersections of the column wires 1002 and row wires 1003 are insulated, and cold cathode devices constituting the pixel 1001 are connected to the electric circuit intersections of the matrix wiring.

In the configuration shown in FIG. 2, the row wires 1003 are selected in sequence on the basis of horizontal synchronization signals of input image signals, and subjected to a predetermined selection voltage supplied from a row selection circuit 8 during the selection period. Meanwhile, modulation signals based on luminance data of selected row wires are applied to the column wires 1002 from a column drive circuit 7 during the selection period. All the rows are sequentially selected, as described above, so as to complete one vertical scanning period, thereby forming an image of one screen.

In a general drive method, if a case with no horizontal blanking period is assumed, then the selection period, for example, is fixed to a predetermined value based on the horizontal scanning period of a received image signal and has the same value for every row.

Figure 1A:
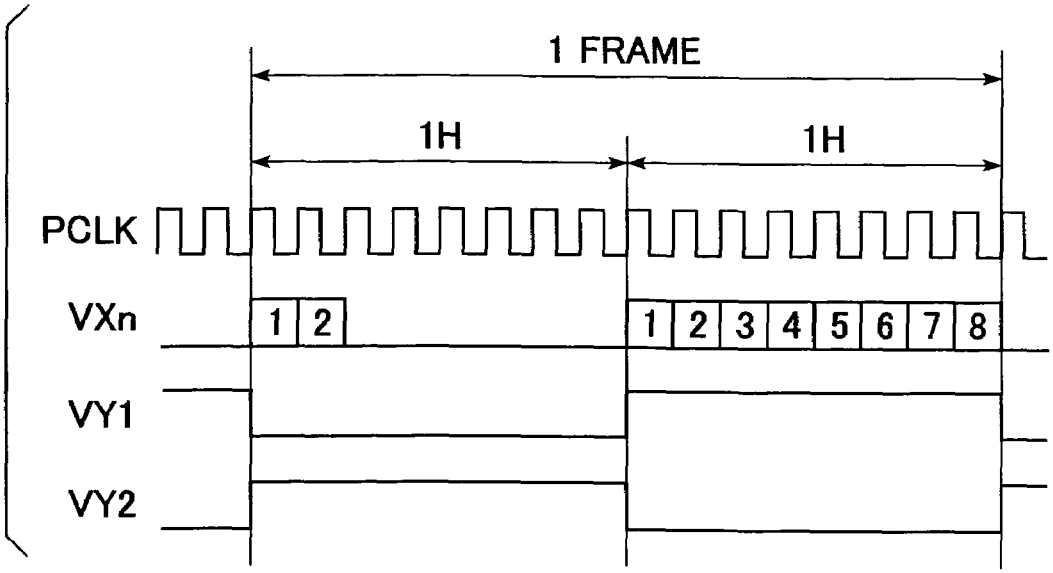
FIGS. 1A and 1B are timing charts for explaining a matrix panel drive control method according to a first embodiment of the present invention.

More specifically, in the case of the 2-row, 2-column matrix panel shown in FIG. 2, the selection time is half the 1-frame time of a received image signal, as shown in FIG. 1A. In this case, VY1 and VY2 denote the drive waveforms applied to the row wires of rows Y1 and Y2, respectively. Reference character VXn denotes a maximum drive waveform in the modulation signal waveform applied to column wires X1 and X2.

To display an image, a selection potential is applied to Y1 of the row wire 1003 for the first half (=1H) of the 1-frame time of an input image signal. A modulation signal for the scanned line of a first row is applied to the column wires 1002 (X1 and X2), so as to display the image of the first row. A selection potential is applied to Y2 of the row wire 1003 for half the latter (=1H) of the 1-frame time of the input image signal. Furthermore, the modulation signal for the scanned line of the second row is applied to the column wires (X1, X2), so as to display the image of the second row. Thus, a 1-frame image is displayed.

Figure 1B:
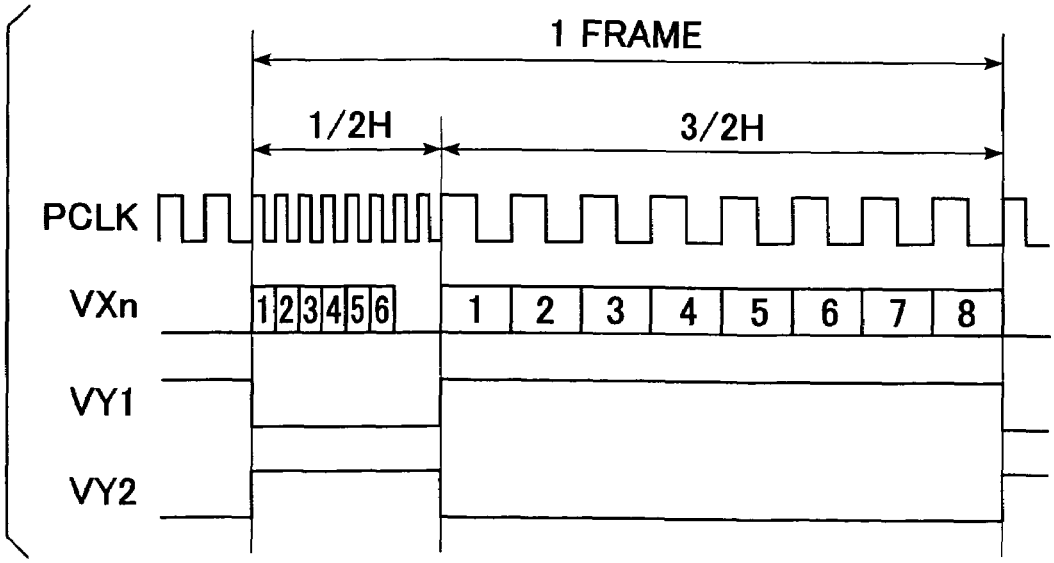

In this embodiment, as shown in FIG. 1B, selection time that has been selected from a predetermined range for each row can be set. This makes it possible to set each selection period so that the selection time differs for each row. The selection period is controlled by a control circuit 100 such that the cycle of a reference clock signal PCLK is set to be relatively long for a selected row whose selection period is relatively long. In other words, the selection period is controlled such that the cycle of the reference clock signal PCLK is set to be relatively short for a selected row whose selection period is relatively short.

A description will now be given of the modulation signals supplied to the column wires.

To generate a modulation signal from luminance data, a pulse width modulator (PWM) counts the pulses of the reference clock signal PCLK and outputs clock pulses until the count reaches the value of the luminance data of the associated column wire.

Figure 3:
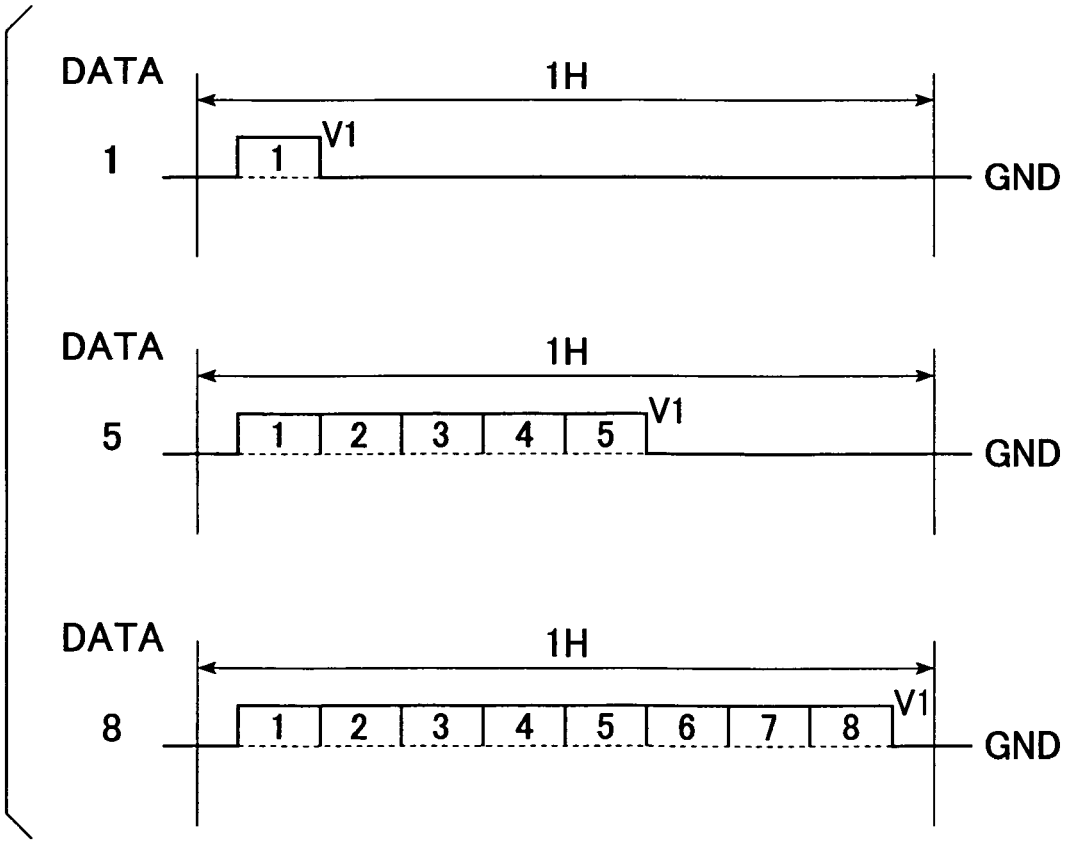
FIG. 3 is a diagram showing modulation signals used in the matrix panel drive control method according to the first embodiment of the present invention.

FIG. 3 shows three examples of output modulation signal waveforms, namely, three cases where the luminance data to be modulated is 1, 5 and 8 (maximum luminance level), respectively.

Referring to FIG. 3, the numerals (1 through 8) in the unit rectangular waveform of the modulation signal denote the luminance data. If, for example, the luminance data is 5, then a unit waveform lasting for the time from 1 through 5 shown in the rectangular boxes is output as a modulation signal. Thereafter, no unit waveform is output.

The unit waveform is sometimes referred to as a time slot in this embodiment.

Figure 4:
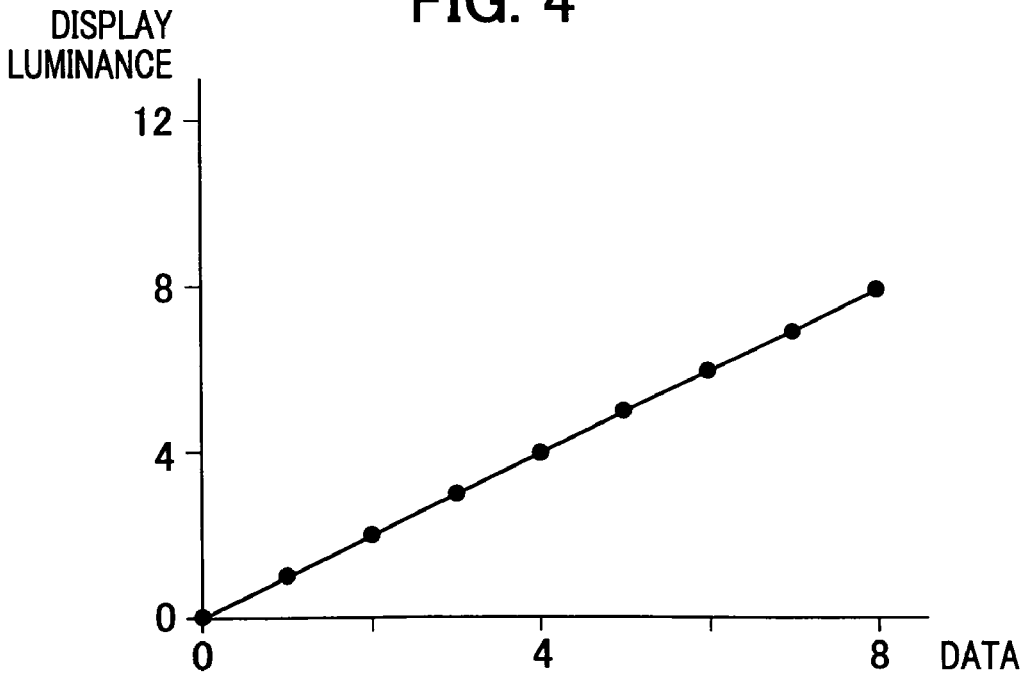
FIG. 4 is a diagram showing display luminance characteristics with respect to luminance data of modulation signals used in the matrix panel drive control method according to the first embodiment of the present invention.

FIG. 4 shows the characteristics of the display luminance of pixels with respect to input luminance data. In this case, the display luminance is normalized using the same values as those of luminance data. Although the luminance data on the axis of abscissa and the display luminance on the axis of ordinates are actually discrete, the dots are connected with a solid line into a straight line to represent characteristics in the explanation hereinafter.

In this embodiment, pulse width modulation is performed on the basis of one modulation reference potential. Therefore, the pixel display luminance is proportional to the time equivalent to the pulse width of the modulation time applied to a pixel.

Referring back to FIGS. 1A and 1B, the present embodiment will be explained in more detail.

For instance, if the maximum value in the luminance data of the first row is 2, as shown in FIG. 1A, then the duration time of a modulation signal waveform VXn shown in FIG. 1A provides the maximum pulse width. There is wasteful time during which the pixel 1001 is not driven in the selection period (1H) of the row wire of the first row. If the maximum value in the luminance data of the second row is set to 8, then the modulation signal waveform is continuously supplied over the selection period (1H), and there is no such wasteful time during which the pixel 1001 is not driven during the selection period (1H) of the second row.

As shown in FIG. 1A, the selection period of the first row includes the aforesaid wasteful time equivalent to six time slots (six gray scales). Hence, the drive time during which the pixel 1001 is actually driven is equivalent only to 10 time slots over the two selection rows. The maximum drive time of one frame is equivalent to 16 time slots, so that it is possible to extend the drive time of the pixel 1001 by $^{16}/_{10}$-fold per frame.

If the number of unit waveforms determined on the basis of the maximum value of pixel data for each selected row is denoted by Mh (Mh=2 or 8 in this example), the total number of Mh's over a plurality of selection periods is denoted by Mf (Mf=2+8 in this example), the total number of displayable unit waveforms over a plurality of selection periods is denoted as Mfx (Mfx=2×8 in this example), and the multiplication coefficient for multiplying the pixel data therewith, as necessary, is denoted by GAIN, then the GAIN is preferably determined on the basis of Mfx/Mf to satisfy GAIN=Mfx/Mf or 1<GAIN<Mfx/Mf. In this case, 1.5, which is smaller than $^{16}/_{10}$, is selected as GAIN.

In this embodiment, the selection time on the second row is extended by 1.5 times, namely, to ⅔H, as shown in FIG. 1B. Accordingly, the cycle of the reference clock signal PCLK is selected within a variable range on the basis of the selection time of the second row, then extended by 1.5 times.

Furthermore, the selection time of the first row is selected within the variable range and set to ½H, and then the cycle of the reference clock signal PCLK is reduced to 0.5-fold, accordingly, on the basis of the selection time of the first row. At this time, however, reducing the cycle of the reference clock signal PCLK to 0.5-fold causes the display luminance of a pixel to be reduced by half if the luminance data remains 2. To compensate for the reduction in the display luminance, therefore, the luminance data of the first row is multiplied by a time gain TGi serving as a multiplication coefficient thereby to perform signal correction so that the luminance data is doubled. This simply brings the luminance of the pixels of the first row back to the same luminance as that in the case where the selection period is fixed (FIG. 1A). Since the time for driving the pixels 1001 of the second row has been extended 1.5 times, the luminance data, which has been corrected by multiplying the luminance data of the first row by data gain DGi, serving as the multiplication coefficient to double the luminance data, is subjected to signal processing to further expand it by 1.5-fold. This increases the luminance of the pixels of each selected row by 1.5-fold, as compared with the luminance of the pixels in the case where the selection period is fixed (FIG. 1A), thus maintaining a balance with the display luminance of the pixels of all rows.

Thus, the ratio of the display luminance in two rows remains unchanged before and after the reference clock signal PCLK. Specifically, the luminance data of the first row is first doubled, and then further expanded by 1.5 times so as to obtain uniform display luminance in a frame. Preferably, a compensating circuit (not shown) is provided in the control circuit 100 so as to carry out signal processing to compensate for deviation of the luminance of the pixels during the selection period from a desired value on the basis of the length of the selection period and/or the cycle of the reference clock signal.

As described above, the multiplication coefficient used to compensate for a reduction in display luminance caused by setting the cycle of the reference clock signal PCLK to 0.5-fold will be referred to as "time gain TGi." The multiplication coefficient that is determined by taking into account that the time for driving the pixels of the second row will be extended by 1.5-fold and that is used to increase the luminance of pixels will be referred to as "data gain DGi."

The reference clock signal PCLK is commonly applied to all columns, so that the multiplication of luminance data of all columns is accomplished by multiplying with the same coefficient for each row. Obviously, in a column wherein the luminance data does not reach the maximum value, the modulation signal pulse width will not exceed a predetermined selection period.

Figure 5:
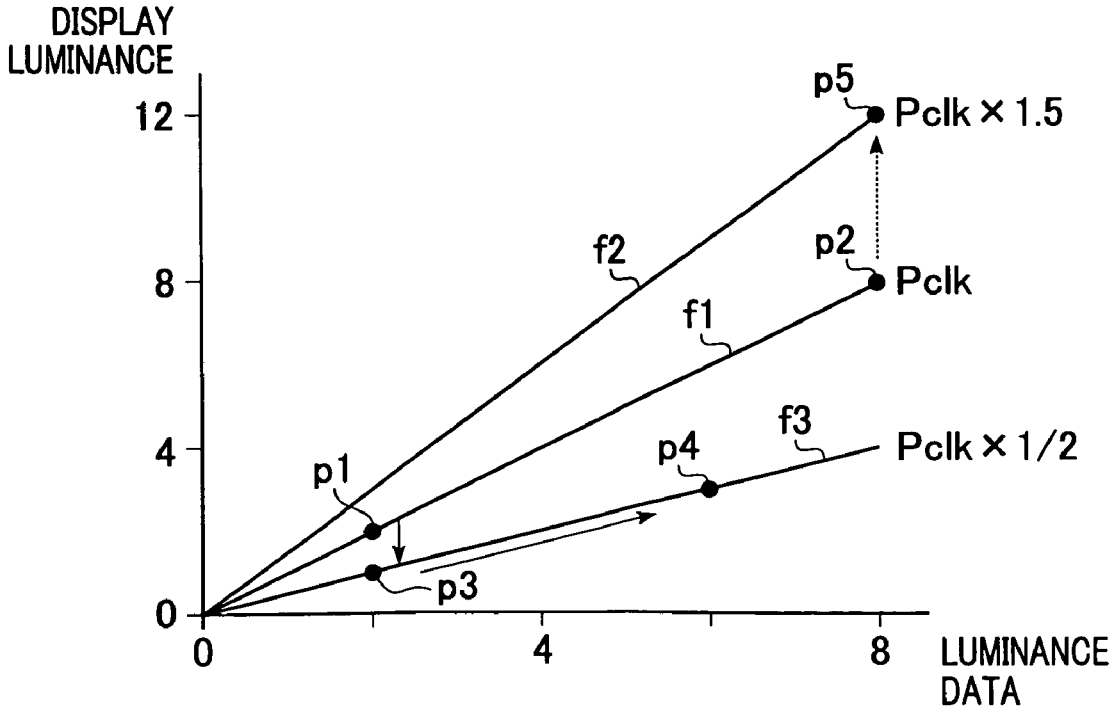
FIG. 5 is a diagram showing display luminance characteristics with respect to luminance data in the matrix panel drive control method according to the first embodiment of the present invention.

FIG. 5 shows the characteristics of the display luminance with respect to input luminance data according to the present embodiment. Both the luminance data and the display luminance have been normalized using the same value. Referring to FIG. 5, f1 indicates the relationship between luminance data and display luminance when the cycle of the reference clock signal PCLK is fixed, and f2 and f3 indicate relationships between luminance data and display luminance when the cycle of the reference clock signal PCLK is set to 1.5-fold and 0.5-fold, respectively.

Reference character p1 denotes a point indicating the display luminance for luminance data 2 when the reference clock signal PCLK is 1-fold, while p2 denotes a point indicating the display luminance for luminance data 8 when the reference clock signal PCLK is 1-fold. The points p1 and p2 indicate the display luminances of the first row and the second row of FIG. 1A.

Meanwhile, in the present embodiment, the display luminance of data 8 of the second row will be the display luminance corresponding to a point p5 on the characteristic f2 since the cycle of the reference clock signal PCLK has been changed by multiplying it by 1.5. The luminance corresponding to luminance data 2 of the first row will be indicated by the point p4 on the characteristic curve f3. If the cycle of signal PCLK is multiplied by 0.5, then the display luminance will correspond to a point p3 on the characteristic curve f3. The luminance data is doubled by being multiplied by the time gain TGi, and further multiplied by the data gain DGi, so as to be expanded by 1.5 times, thus reaching the display luminance at the point p4.

It can be seen that adjusting the reference clock signal and selection period in the present embodiment increases the display luminance of the luminance data 2 of the first row from point p1 to point p4, and the display luminance of the luminance data 8 of the second row from point p2 to point p5, indicating 1.5-fold display luminance in both cases.

Meanwhile, in the case of the first row having low luminance, as shown in FIG. 1B, the selection time is shorter and the light emitting time at the background level at a half selection voltage in a pixel whose luminance data is 0 and which is basically not to emit light is set to be shorter, allowing the black level luminance to be reduced. Thus, the contrast can be further improved.

It has been found that the values of luminance data are small, on average, in actual display of a natural image, and when fixed time is allocated to the row wire selection periods, as in the conventional example, it is very likely that wasteful time, during which no pixel is driven, will result. The present embodiment described above allows the wasteful time to be efficiently allocated to effective light emitting periods.

Moreover, appropriately allocating selection time on the basis of luminance data so as to control the total row wire selection time to be, for example, the time equivalent to one frame or less, makes it possible to prolong the light emitting time of pixels per frame so as to provide a brighter display image.

The PWM counts clock pulses of the reference clock signal PCLK and continues to output a modulation reference potential until the count value reaches the value of the luminance data of the associated column wire. Hence, setting the reference clock signal PCLK to be variable for each selected row and using clock pulses of a cycle selected within a predetermined range of cycle on the basis of the luminance data of the pixels of a selected row makes it possible to output modulation signals having different pulse widths even if the same luminance data is applied.

Second Embodiment

The drive method for a matrix panel in accordance with a second embodiment of the present invention differs from the aforementioned first embodiment in modulation method.

The second embodiment uses a modulation method called "multivalued PWM", combining pulse width modulation (PWM) and pulse height modulation (PHM).

According to the modulation method of the second embodiment, clock pulses of the reference clock signal PCLK are counted to determine the pulse width and pulse height corresponding to luminance data. Specifically, when a modulation signal waveform can no longer be expanded in the direction of amplitude, it is expanded in the direction of pulse width.

Figure 6:
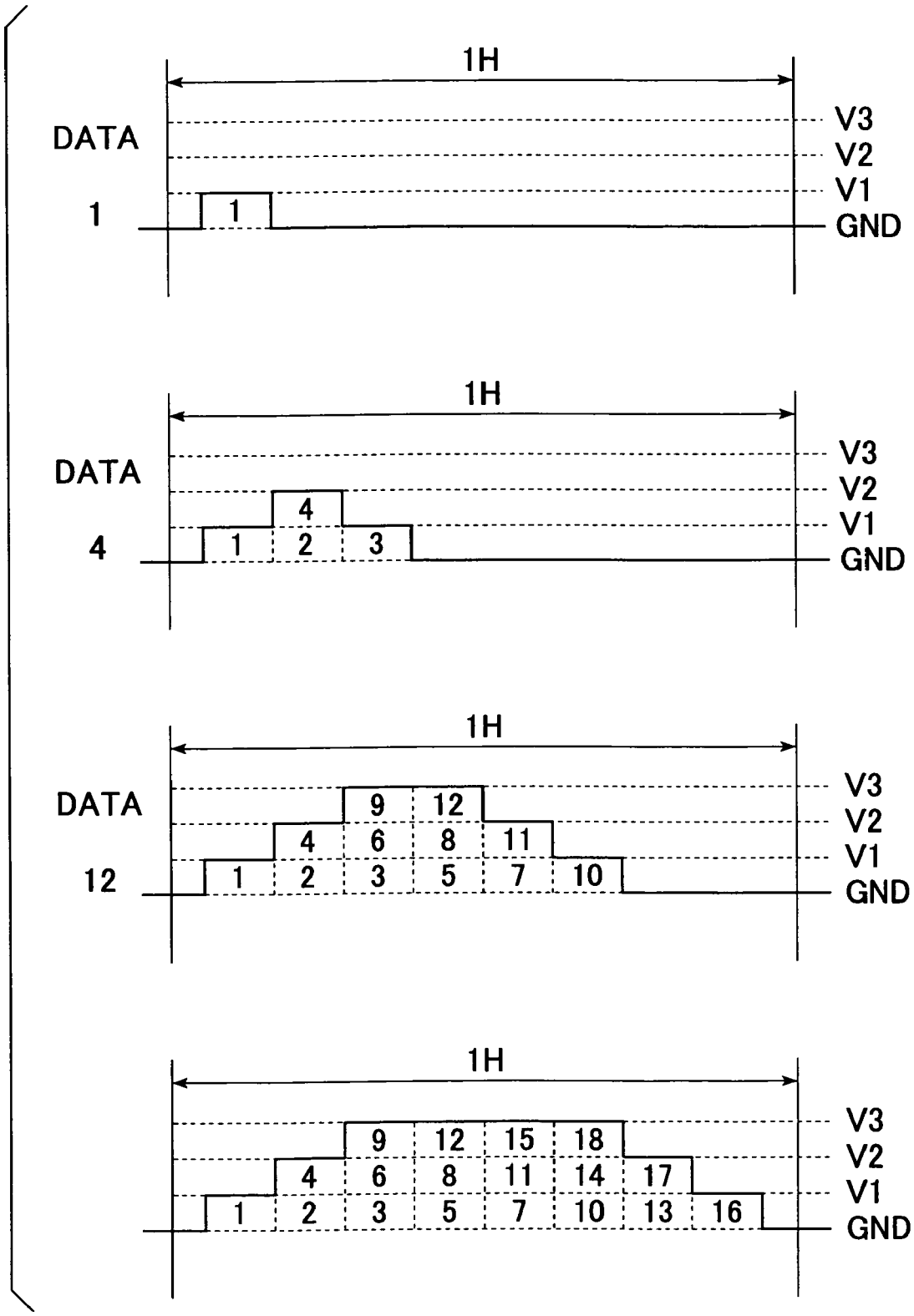
FIG. 6 shows modulation signals used in the matrix panel drive control method according to a second embodiment of the present invention.

FIG. 6 shows cases where the luminance data to be modulated is 1, 4, 12 and 18 (maximum luminance level), respectively. In these cases also, the modulation signals can be considered to be formed of unit waveforms. The numerals (1 through 18) in the rectangular boxes indicating unit waveforms mean luminance data.

FIG. 6 shows modulation signal waveforms of luminance data when the selection period is 1H.

Figure 7:
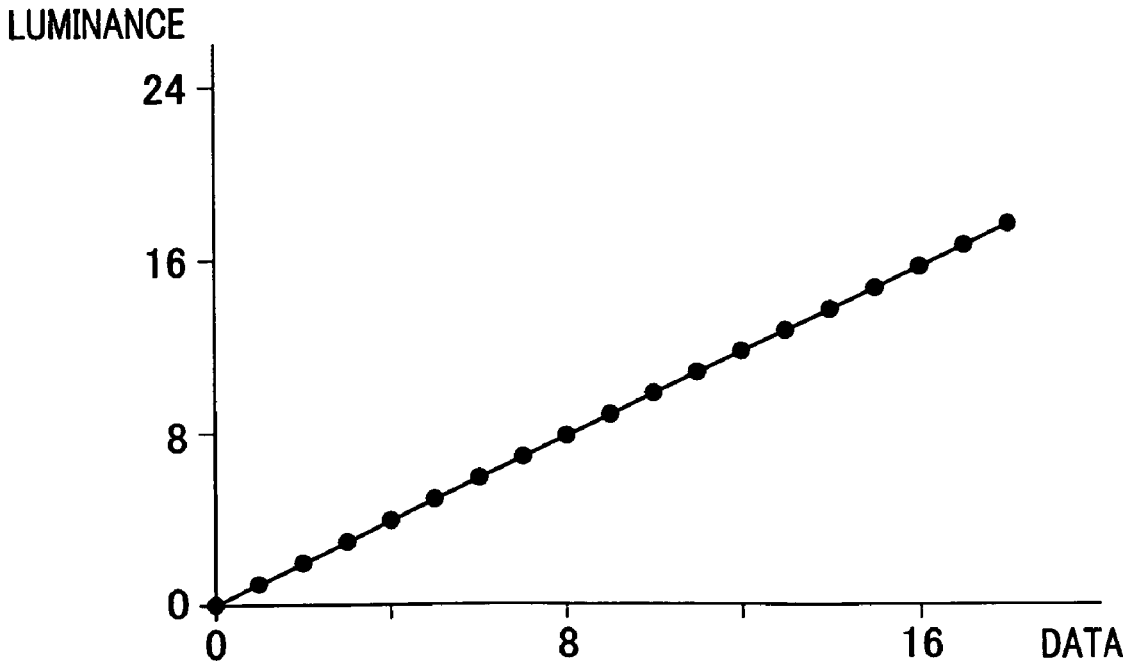
FIG. 7 is a diagram showing display luminance characteristics with respect to luminance data of modulation signals used in the matrix panel drive control method according to the second embodiment of the present invention.

FIG. 7 shows characteristics of display luminance (normalized) with respect to input luminance data. In this embodiment, modulation reference voltages GND, V1, V2 and V3 determining pulse height, as shown in FIG. 6, are appropriately selected according to the characteristics of the devices constituting pixels so as to obtain linear luminance characteristics with respect to the luminance data.

In this embodiment, GND, V1, V2 and V3 have been used as the modulation reference voltages. Alternatively, however, five values, six values, up to 10 values, for example, may be used as long as there are three values (e.g., GND, V1 and V2) or more.

The second embodiment uses the same drive method as that of the first embodiment.

The matrix panel to be explained may be one similar to that shown in FIG. 2, as described in the first embodiment.

Figure 8A:
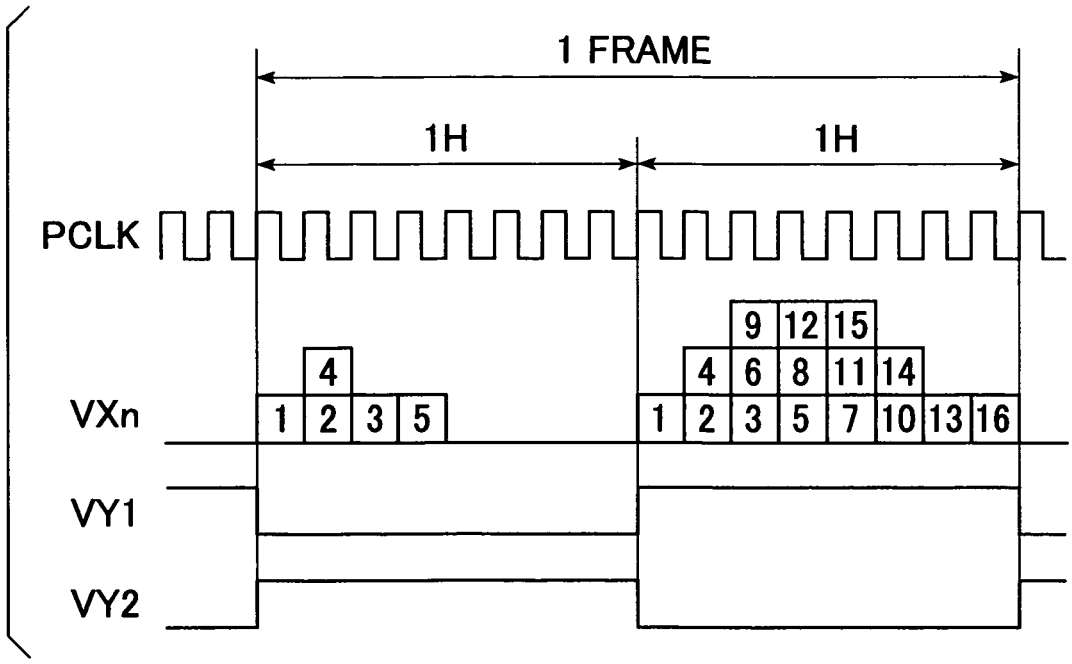
FIGS. 8A and 8B are timing charts for explaining a matrix panel drive control method according to a second embodiment of the present invention.
Figure 8B:
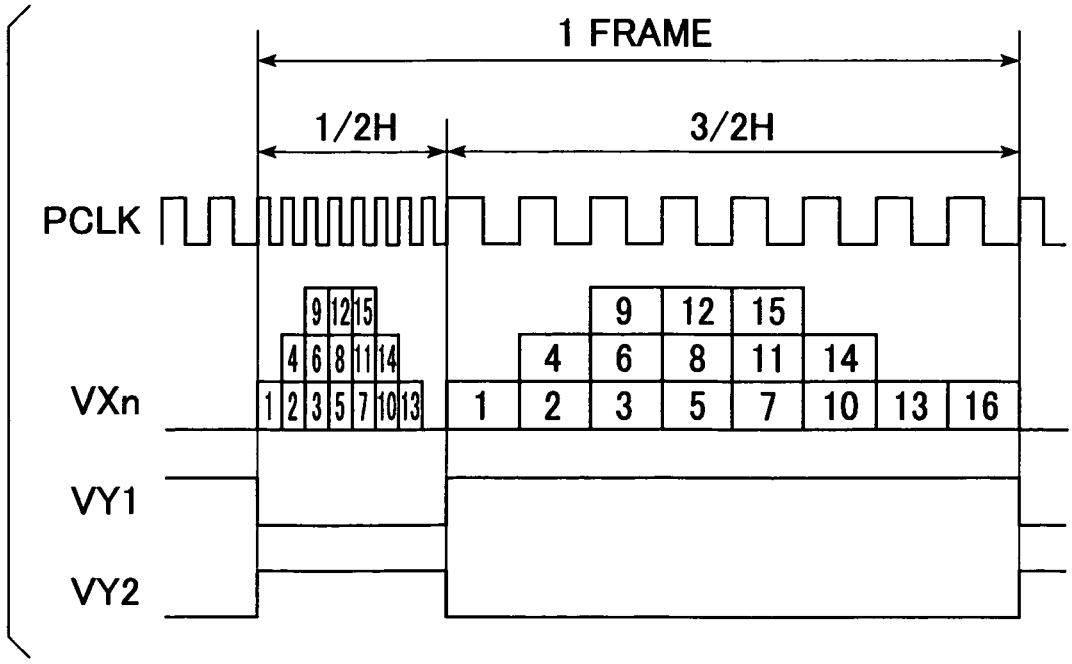

Referring now to FIGS. 8A and 8B, the drive method according to the second embodiment will be explained.

If the maximum value of the luminance data of a first row is 5, and the maximum value of the luminance data of a second row is 16, then a modulation signal waveform VXn shown in FIG. 8A is obtained. In this case, if the blanking period is not considered, then doubling the fixed selection period (1H) provides the time of one frame.

A modulation signal waveform according to the second embodiment will be as indicated by VXn in FIG. 8B. There are 18×2 slots of unit waveforms that can be applied in one frame, as shown in FIG. 6, while there are 5+16=21 slots of unit waveforms that contribute to light emitting.

In this embodiment, the selection time of a second row is extended to 1.5-fold (=3/2H), and the cycle of the reference clock signal PCLK in the selection period of the second row is extended to 1.5-fold, accordingly. Furthermore, the selection time of the first row is set to the remaining time, namely, 1/2H. Accordingly, the cycle of the reference clock signal PCLK in the selection period of the first row is reduced to 0.5-fold. Setting the cycle of the reference clock signal PCLK to 0.5-fold leads to reduced display luminance; therefore, in order to compensate for the reduction in display luminance, the luminance data of the first row is corrected by doubling it. Furthermore, since the drive time of the pixels of the second row has been extended 1.5-fold, the luminance data of the first row is further expanded 1.5-fold. This results in uniform display luminance over all rows in the frame. In this case also, if the number of unit waveforms determined on the basis of the maximum value of pixel data for each selected row is denoted by Mh (Mh=5 or 16 in this example), the total number of Mh's over a plurality of selection periods is denoted by Mf (Mf=5+16 in this example), the total number of displayable unit waveforms over a plurality of selection periods is denoted as Mfx (Mfx=2×18 in this example), and the multiplication coefficient for multiplying the pixel data therewith, as necessary, is denoted by GAIN, then the GAIN is preferably determined on the basis of Mfx/Mf so as to satisfy GAIN=Mfx/Mf or 1<GAIN<Mfx/Mf. In this case, 1.5, which is smaller than $^{36}/_{21}$, is selected as GAIN.

Thus, the modulation signal waveform according to the present embodiment will be as shown in FIG. 8B. Even if the multivalued PWM modulation is used, a selection period can be properly determined for each row, allowing the same advantages as those of the first embodiment to be obtained.

Third Embodiment

The matrix panel drive method in accordance with a third embodiment of the present invention differs from the aforementioned first and second embodiments in modulation method.

The third embodiment uses the same multivalued PWM as the second embodiment, in that the pulse width modulation (PWM) and pulse height modulation (PHM) are combined, but differs from the second embodiment in the order in which unit waveforms are arranged.

In the modulation method according to the third embodiment, the pulses of the reference clock signal PCLK are counted to determine the pulse width and height corresponding to luminance data. More specifically, the modulation signal waveform is expanded in the direction of time, and when it can no longer be expanded in the direction of time, it is expanded in the direction of height.

Figure 9:
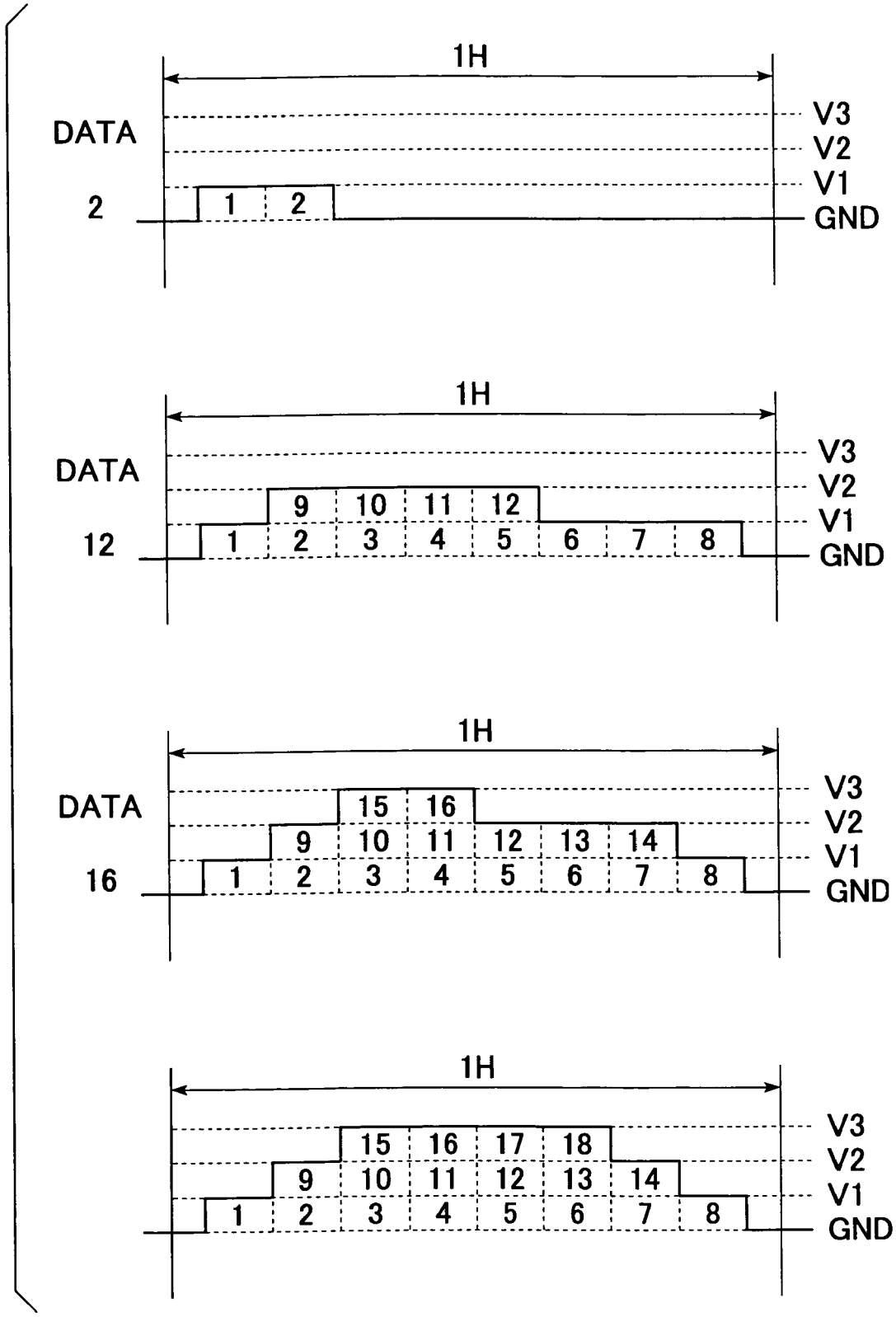
FIG. 9 is a diagram showing modulation signals used in the matrix panel drive control method according to a third embodiment of the present invention.

FIG. 9 shows cases where the luminance data to be modulated are 2, 12, 16 and 18, respectively. In these cases, the selection period is denoted as 1H, and modulation signal waveforms corresponding to the luminance data of 0 through 18 in the period of 1H are shown.

Figure 10:
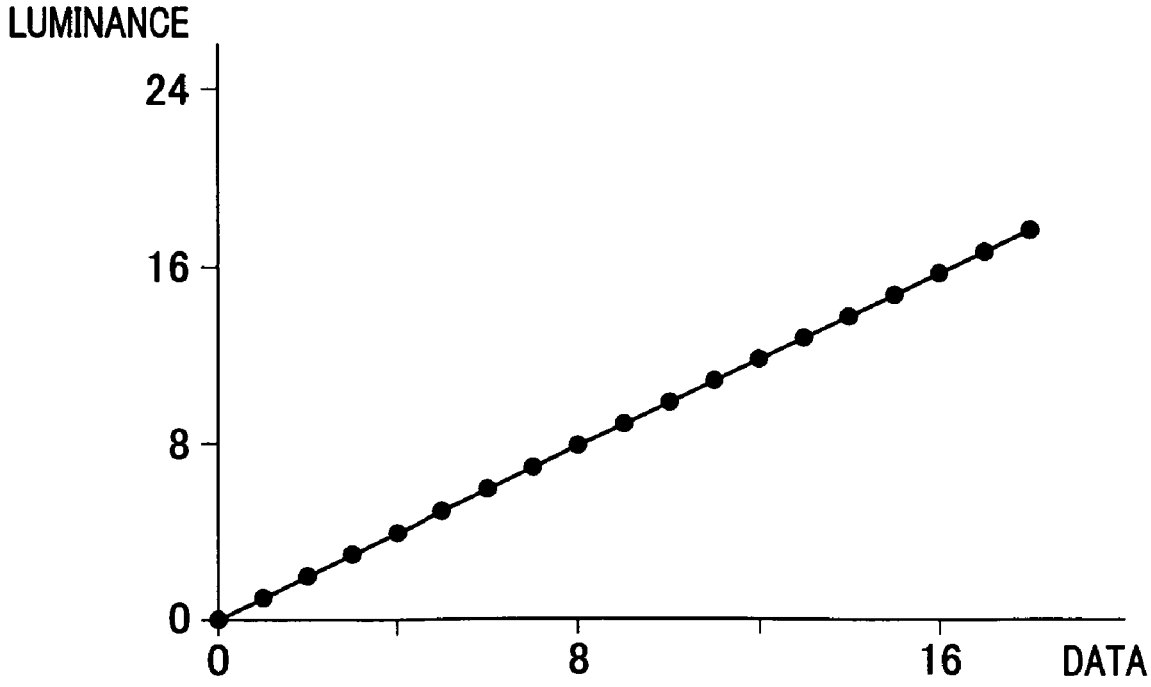
FIG. 10 is a diagram showing display luminance characteristics with respect to luminance data of modulation signals used in the matrix panel drive control method according to the third embodiment of the present invention.

FIG. 10 shows the characteristics of display luminance (normalized) with respect to input luminance data. In this embodiment also, modulation reference voltages GND, V1, V2 and V3 are appropriately selected so as to obtain linear display luminance characteristics with respect to the luminance data.

Figure 11A:
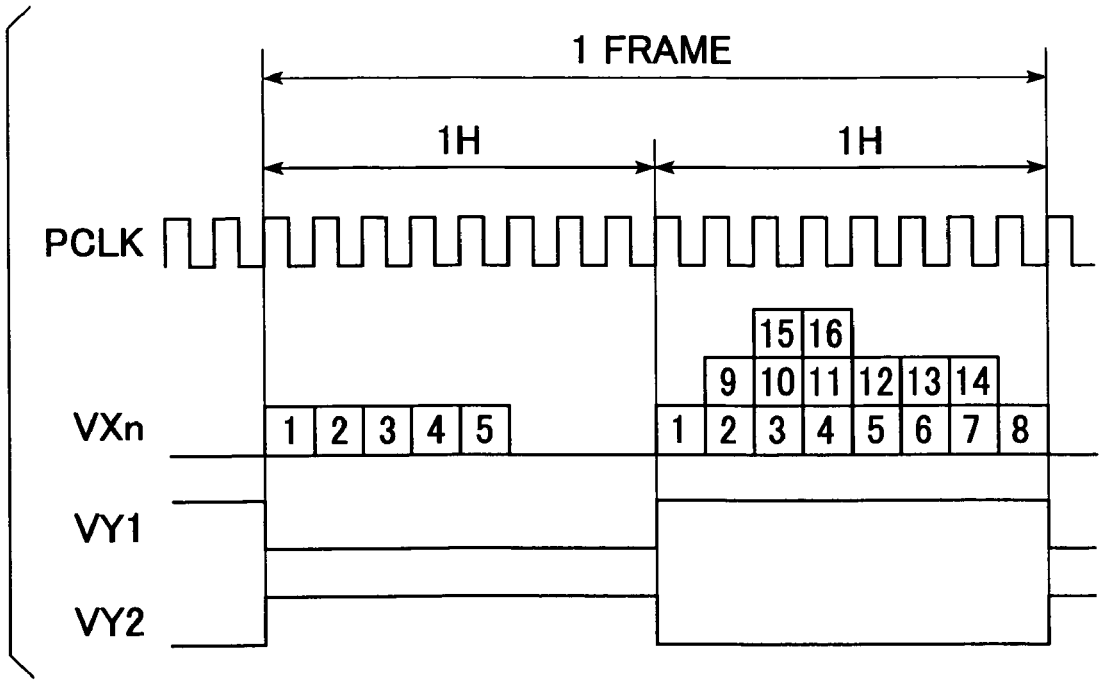
FIGS. 11A and 11B are timing charts for explaining a matrix panel drive control method according to a third embodiment of the present invention.

If the maximum value of the luminance data of a first row is 5, and the maximum value of the luminance data of a second row is 16, then the modulation signal waveforms shown in FIG. 11A are obtained. If the blanking period is not considered, then doubling the fixed selection period (1H) provides the time of one frame.

Figure 11B:
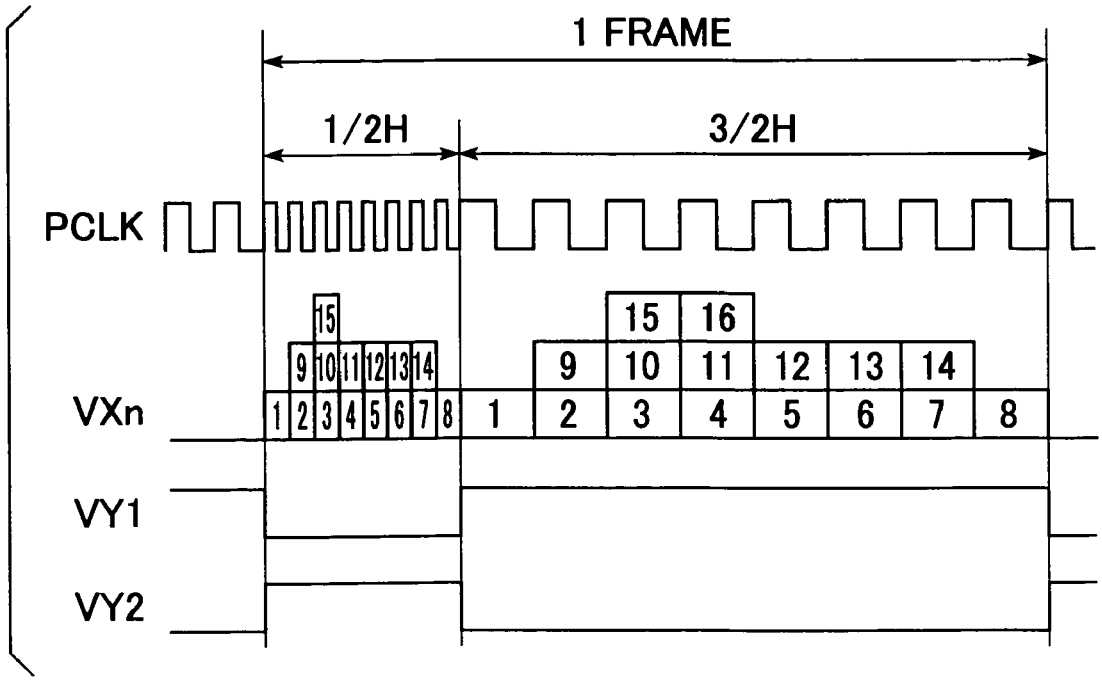

There are 18×2 slots of unit waveforms that can be applied in one frame, as shown in FIGS. 9, 11A and 11B, while there are 5+16=21 slots of unit waveforms that actually contribute to light emitting. Reallocating the selection time of the first and second rows may allow the time and voltage for driving pixels to be increased.

In this embodiment, the selection time of the second row is extended to 1.5-fold (=3/2H), and the cycle of the reference clock signal PCLK in the selection period of the second row is extended 1.5-fold, accordingly. Furthermore, the selection time of the first row is set to the remaining time, namely, 1/2H. Accordingly, the cycle of the reference clock signal PCLK in the selection period of the first row is reduced 0.5-fold. Setting the cycle of the reference clock signal PCLK to 0.5-fold leads to reduced display luminance; therefore, in order to compensate for a reduction in display luminance, the luminance data of the first row is corrected by doubling it. Furthermore, since the drive time of the pixels of the second row has been extended 1.5-fold, the luminance data of the first row is further expanded 1.5-fold. This results in uniform display luminance over all rows in the frame. In this case also, if the number of unit waveforms determined on the basis of the maximum value of pixel data for each selected row is denoted by Mh (Mh=5 or 16 in this example), the total number of Mh's over a plurality of selection periods is denoted by Mf (Mf=5+16 in this example), the total number of displayable unit waveforms over a plurality of selection periods is denoted as Mfx (Mfx=2×18 in this example), and the multiplication coefficient for multiplying the pixel data therewith, as necessary, is denoted by GAIN, then the GAIN is preferably determined on the basis of Mfx/Mf to satisfy GAIN=Mfx/Mf or 1<GAIN<Mfx/Mf. In this case, 1.5, which is smaller than $^{36}/_{21}$, is selected as GAIN.

Thus, modulation signal waveforms according to the present embodiment will be as shown in FIG. 11B. Even if the multivalued PWM modulation shown in FIG. 9 is used, a selection period can be properly determined for each row, allowing the same advantages as those of the aforementioned first and second embodiments to be obtained.

Although the selection period and the cycle of the reference clock signal have been determined for each selected row, the selection period and the reference clock signal cycle do not have to be different for every row, as long as they are different in at least two rows out of all rows.

Fourth Embodiment

Figure 12:
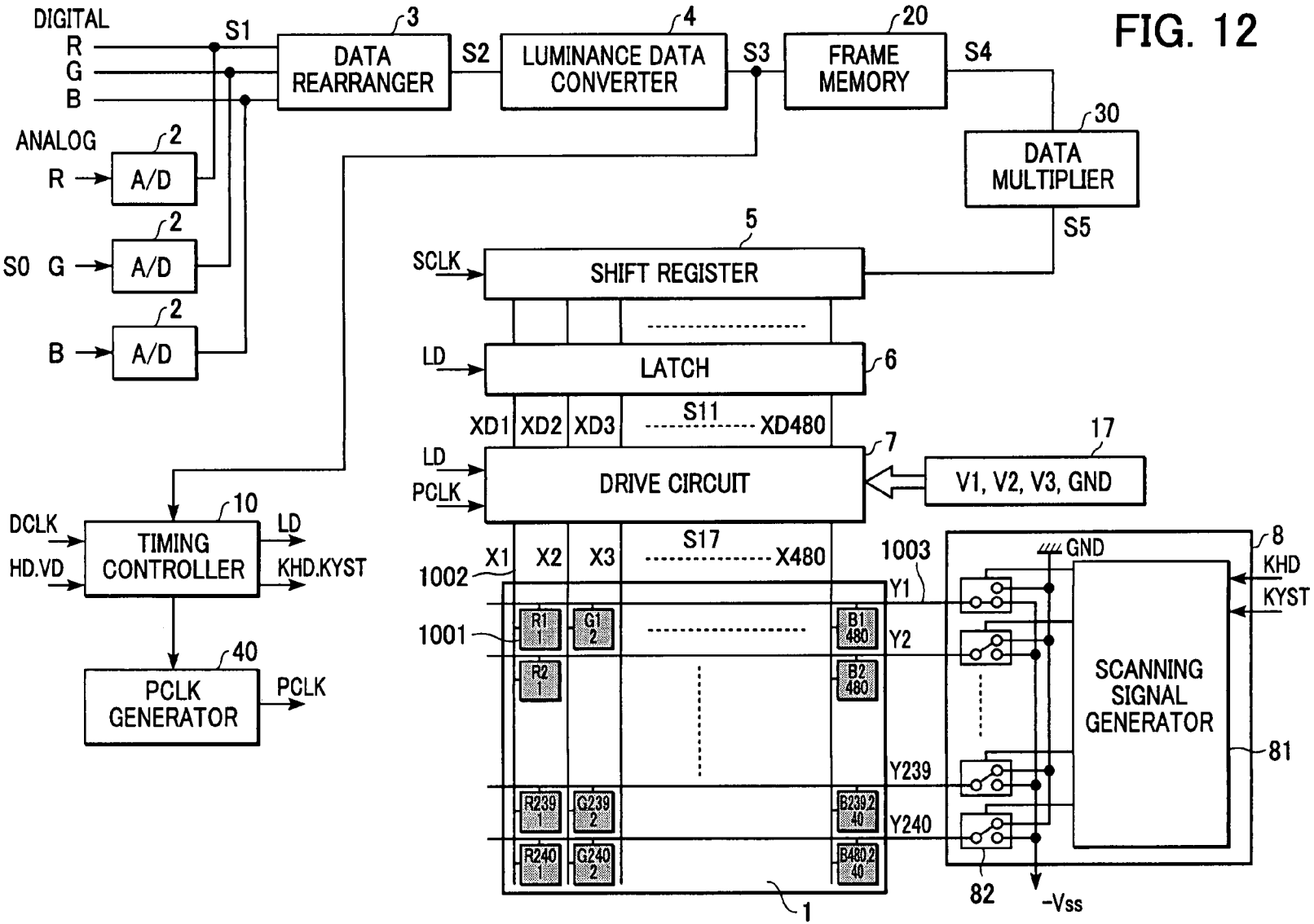
FIG. 12 is a block diagram showing another matrix panel drive control apparatus according to the present invention.
Figure 13:
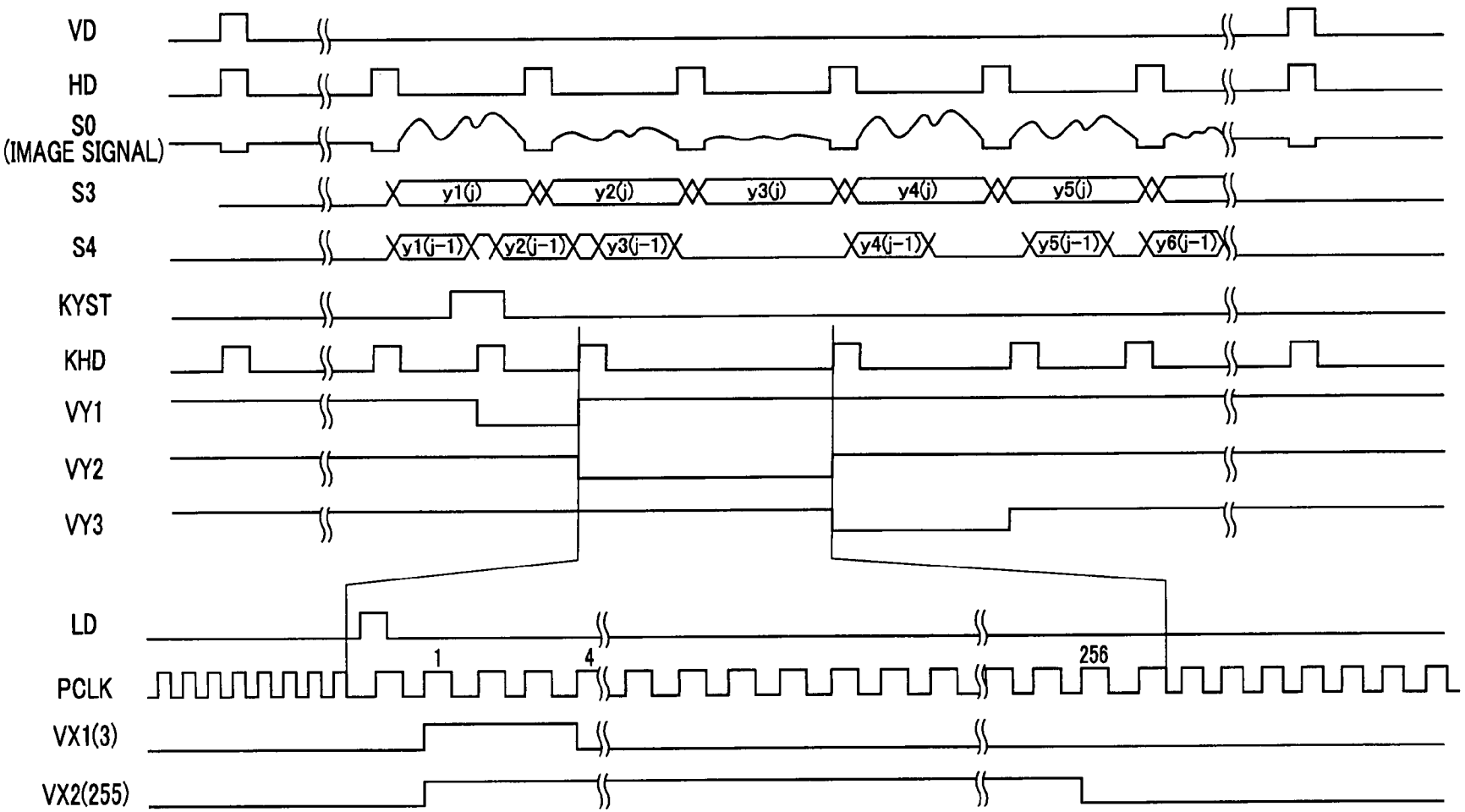
FIG. 13 shows timing charts for explaining the matrix panel drive control method used in the present invention.
Figure 14:
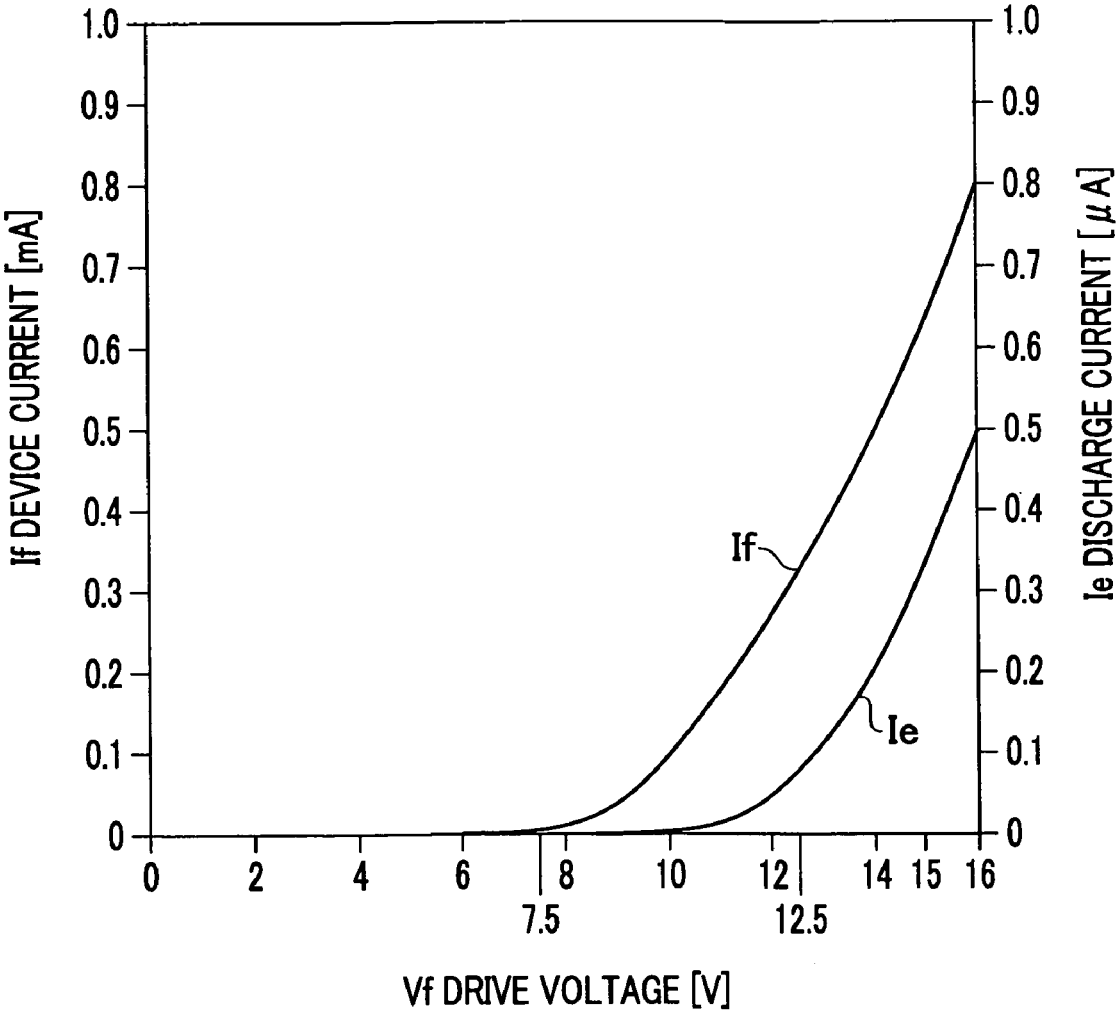
FIG. 14 is a diagram showing an example of luminance data characteristics with respect to image data.

Referring to FIGS. 12, 13 and 14, a fourth embodiment will be explained. The present embodiment relates to a drive control method for a matrix panel ideally used when the aforementioned first embodiment is applied to a display unit having a multi-electron source.

The basic composition of the drive control method according to the fourth embodiment is identical to that of the aforementioned first embodiment.

Referring to FIG. 12, a matrix panel 1 is formed of a thin vacuum vessel incorporating a multi-electron source formed of a number of arranged electron sources, e.g., cold cathode devices 1001, on a substrate, and image forming members, such as fluorescent members, which oppose the electron sources to form images when irradiated by electrons. The cold cathode devices 1001 constituting pixels are disposed in the vicinities of the intersections of column wires 1002 and row wires 1003 and connected to these two types of wires. The cold cathode devices 1001 can be precisely positioned and formed on a substrate using a manufacturing technique, such as photolithography etching, making it possible to arrange numerous cold cathode devices 1001 at minute intervals. Moreover, as compared with hot cathodes conventionally used with CRTs or the like, the cathodes themselves and their surroundings can be driven at a relatively low temperature. This makes it possible to easily accomplish a multi-electron source arranged with finer pitches.

Preferably, the surface-conductive electron emitting devices disclosed in, for example, Japanese Unexamined Patent Application Publication No. 10-039825, are used for the cold cathode devices.

FIG. 14 shows an example of the relationship among device drive voltage Vf, device current If and discharge current Ie of the surface-conductive electron emitting devices. In FIG. 14, the axis of abscissa indicates the device drive voltage Vf of the surface-conductive electron emitting devices, and the axes of ordinates indicate the device current If and the discharge current Ie. As can be seen from FIG. 14, the discharge current Ie has a threshold voltage (about 7.5 V), so that the discharge current Ie does not flow at a voltage of the threshold voltage level or less. At a voltage above the threshold voltage level, the discharge current Ie flows on the basis of the device voltage applied. This characteristic is utilized to accomplish the simple matrix drive described below.

A matrix panel 1 shown in FIG. 12 is formed of a thin vacuum vessel containing a multi-electron source having cold cathode devices 1001 arranged on a substrate. As shown in FIG. 1, for example, 480 devices, i.e., 160 pixels (RGB)×3, are arranged horizontally, while 240 devices, for example, are arranged vertically. The number of the devices is not limited to the above; the required number of devices is determined according to the application of a finished product. The cold cathode devices 1001 of the matrix panel 1 are represented according to the colors for displaying images, Ru, v (u=1, 2, 3, . . . 240, v=1, 4, 7, . . . 478), Gu, v (u=1, 2, 3, . . . 240, v=2, 5, 8, . . . 479), Bu, v (u=1, 2, 3, . . . 240, v=3, 6, 9, . . . 480). The matrix panel 1 has pixels arranged in, for example, an RGB stripe array.

An analog-to-digital converter (A/D converter) 2 converts analog RGB component signals S0, which have been decoded, for example, from NTSC signals to RGB signals by a decoder (not shown), into digital RGB signals of, for example, an 8-bit width (S1).

A data rearranger 3 functions to receive digital RGB signals (S1) of the A/D converter 2 or a computer or the like, rearrange the digital data of each color according to the arrangement of the pixels of the matrix panel 1, and output the rearranged digital data (image data S2).

A luminance data converter 4 has a conversion table for converting the characteristic of received image data S2 into a desired luminance characteristic. For instance, the luminance data converter 4 converts the image data S2 into luminance data S3 for inversely converting a signal whose display characteristic has been gamma-corrected for a CRT. The order of the processing carried out by the data rearranger 3 and the one carried out by the luminance data converter 4 may be reversed.

A frame memory 20 stores the luminance data of one frame at the timing of a received image signal, and reads the stored luminance data of the preceding frame at the timing, which will be discussed hereinafter. A luminance data multiplier 30 multiplies the luminance data S4 by the coefficient determined for each scanned line (row wire).

A shift register 5 sequentially shifts and transfers the luminance data S5 output from the luminance data multiplier 30 at the timing of a shift clock signal SCLK, and outputs in parallel the luminance data associated with individual devices of the matrix panel 1. A latching circuit 6 latches in parallel the luminance data from the shift register 5 by a load signal LD synchronized with a horizontal synchronization signal, and retains the luminance data until the next load signal LD is received.

A column drive circuit 7 counts clock pulses of the reference clock signal PCLK for pulse width modulation and supplies modulation signals having pulse widths based on the received luminance data to the column wires of the matrix panel 1 so as to drive all the column wires.

A power circuit 17 supplies two levels of modulation reference voltages, V1 and GND, that can be selected on the basis of pixel data, to the column drive circuit 7. As will be discussed hereinafter, the multivalued PWM may involve at least three or more modulation reference-voltages (V1, V2, V3 and GND).

A scanning driver 8, serving as a row selection circuit, is connected to the row wires 1003 of the matrix panel 1. A scanning signal generator 81 sequentially shifts KYST signals synchronized with the vertical synchronization signal of an input image signal in response to a signal KHD determined by a timing controller 10, and outputs selection/nonselection signals in parallel on the basis of the number of row wires. A switching device 82 formed of a MOS transistor or the like switches between a selection potential (−Vss) and a nonselection potential (GND) and outputs one of the potentials according to the output level of the selection/nonselection signal from the scanning signal generator 81.

The timing controller 10 creates a control signal having a desired timing to be supplied to each functional block mainly from input image synchronization signals HD and VD, a data sampling clock signal DCLK and luminance data S3.

The timing controller 10 generates the row selection time for performing a display function, the timing for reading from the frame memory 20 and the load timing for the drive circuit 7 from the output S3 of the luminance data converter 4, and then outputs the KHD signal.

A reference clock signal generator 40 for generating a modulation reference clock signal determines and outputs the cycle of the reference clock signal PCLK for each row selection time determined for each scanned line (row wire). The reference clock signal generator 40 may generate clock pulses by, for example, a voltage control oscillator (not shown) or a phase lock loop or the like, or switch among a plurality of clock signals and output them.

FIG. 13 is a timing chart for explaining the drive control method for a matrix panel shown in FIG. 12.

Referring to FIG. 12, the A/D converter 2 converts, for example, analog RGB component signals S0, which have been decoded from NTSC signals into RGB signals by a decoder (not shown), into digital RGB signal S1 having, for example, an 8-bit width. Although not shown, ideally, the sampling clock signal DCLK is generated by a PLL on the basis of a synchronization signal. The data rearranger 3 receives the digital RGB signals S1 of the A/D converter 2, a computer or the like. Determining the number of pieces of data per scanned line (1H) on the basis of the number of the pixels of the column wires of the matrix panel 1 makes the processing easier. In this embodiment, the number of pixels of the column wires of the matrix panel 1 is set to 160. The digital RGB signals (S1) of the A/D converter 2, the computer or the like are output in synchronization with a data sampling clock signal DCLK (not shown).

Figure 15:
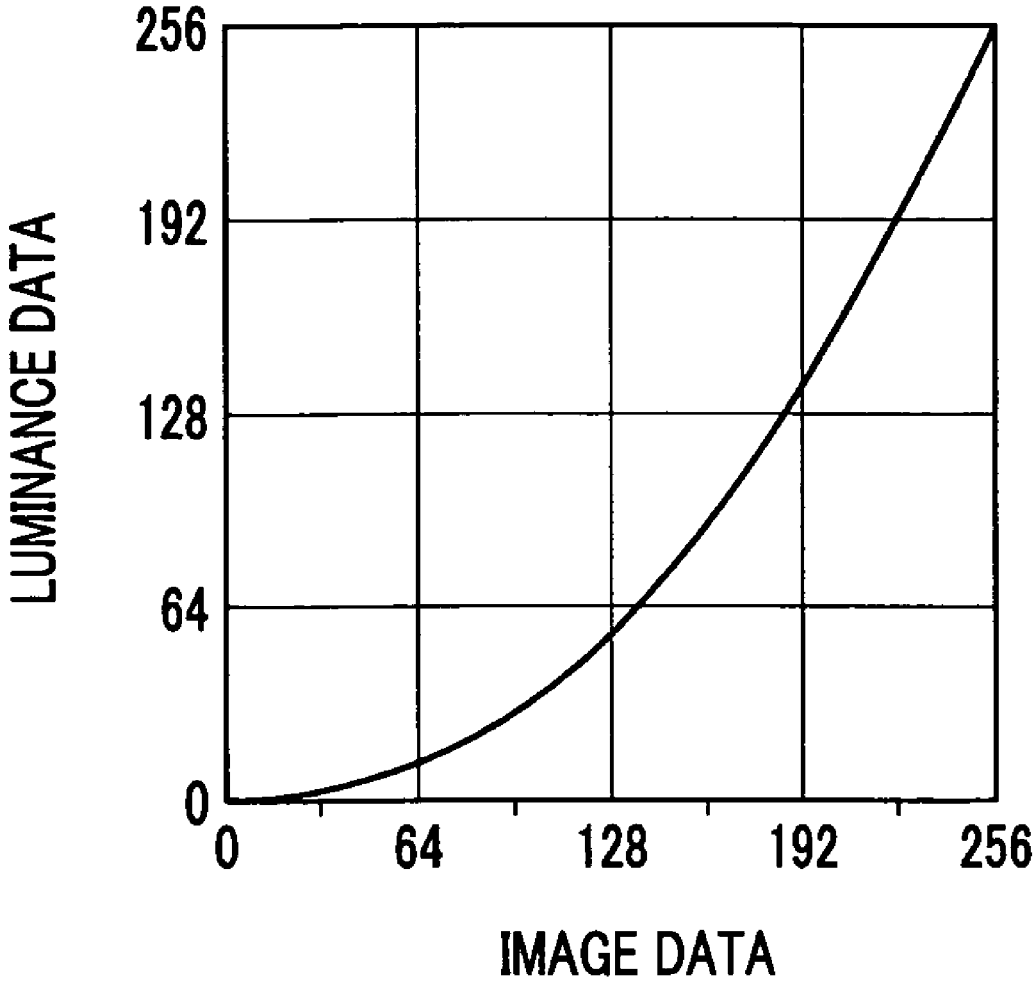
FIG. 15 is a diagram showing the characteristics of a conversion table.

The input signals S1 of the data rearranger 3 that carry the RGB parallel signals are sequentially output according to the arrangement of the RGB pixels of the matrix panel 1, the RGB parallel signals being switched at a timing of a clock signal 3DCLK (not shown) having a frequency that is three times the frequency of the data sampling clock signal DCLK. The output signal S2 of the data rearranger 3 is supplied to the luminance data converter 4. The luminance data converter 4 refers to a conversion table ROM (not shown) in which desired data has been stored beforehand so as to convert, for example, the output signal S2 of an 8-bit width of the data rearranger 3 into, for example, luminance data S3, whereby the characteristic of a display system is turned into a luminance characteristic equivalent to the gamma characteristic of a CRT. An example of the characteristics of the conversion table is shown in FIG. 15.

As shown in FIG. 13, the luminance data S3 output from the luminance data converter 4 is written to a frame memory 20 at a timing of a received image signal. At the same time, data is read from the frame memory at a timing determined by a timing controller. More specifically, luminance data S4 of the preceding frame is read from the frame memory in synchronization with the KHD signal generated by the timing controller 10. In FIG. 13, yq(r), shown in the luminance signals S3 and S4, refers to the luminance data of a q-th row of a frame number r.

Next, a data multiplier 30, serving as a compensating circuit, multiplies the luminance data S4 by the coefficient for each row that is determined by the timing controller 10, then outputs the result to the shift register 5 (S5).

The luminance data is sent to the shift register 5 and sequentially shifted and transferred at the shift clock signal SCLK. The luminance data associated with the individual devices of the matrix panel 1 is subjected to serial-to-parallel conversion, and then the processed luminance data is output. The latch 6 latches the luminance data, which has been subjected to the serial-to-parallel conversion, at the rise of a load signal LD synchronized with the KHD signal and retains the luminance data until the next load signal LD is received.

As can be understood from FIG. 13, the shift and transfer time for sending luminance data to the shift register 5 is set to be shorter than the minimum selection time decided by the timing controller 10. For instance, the cycle of the reference clock signal PCLK is set to be ½-fold or more, and the frequency of the shift clock signal SCLK is determined such that shift and transfer is implemented within a corresponding time. Alternatively, the cycle of the shift clock signal SCLK itself may be controlled so as to change the cycle of the reference clock signal PCLK, which will be discussed hereinafter, so as to shift and transfer data within selection time that changes.

In this embodiment, it is required to perform shift and transfer in a shorter time than the conventional shift and transfer time. Ideally, therefore, luminance data is, for example, formed to have a multi-layer configuration so as to simultaneously transfer luminance data S5 in parallel to a shift register 5 without increasing the frequency of the shift clock signal.

Using the time of the load signal LD as its reference, the drive circuit 7 outputs a modulation signal having its length determined by luminance data to column wires X1 through X480 to drive them in synchronization with the reference clock signal PCLK. Referring to FIG. 13, the numerals included in parenthesis, e.g., VX1 (3), VX2 (255), indicate examples of luminance data.

A scanning driver 8 drives the row wires by sequentially transferring the signal determining the scanning start time, namely, a signal KYST synchronized with the vertical synchronization signal of the input image signal shown in FIG. 13, in synchronization with the clock signal KHD. The row wires are scanned in sequence to form an image.

In this embodiment, the scanning driver 8 drives a first row wire (Y1) to a 240th row wire (Y240), in order, at a selection voltage −Vss (e.g., −7.5V) in synchronization with KHD. At this time, the scanning driver 8 drives the remaining row wires, which have not been selected, at a nonselection voltage 0 V.

The discharge current Ie flows into the cold cathode device 1001 in the row wire selected by the scanning driver 8 and in the column to which the drive circuit 7 outputs a pulse width modulation signal (drive signal). The device current If does not flow into devices associated with the column wires to which the drive circuit 7 issues no drive signals, so that the discharge current Ie does not flow, resulting in no light emission. Thus, the scanning driver 8 sequentially drives the first row wire to the 240th row wire at the selection voltage in synchronization with KHD, while the drive circuit 7 drives an associated column wire by a drive signal S17 corresponding to luminance data so as to form an image.

The scanning driver 8 is preferably operated to simultaneously select two or more row wires to improve luminance.

A description will now be given of a method for allocating selection time, that is, a method for generating KHD, PCLK and the coefficients of the data multiplier.

The timing controller 10 receives the luminance data S3 and determines a maximum value MDi ("i" denoting a scanned line number) of luminance data from a group of luminance data associated with all columns for each scanned line, that is, each selected row.

Then, a first multiplication coefficient (time gain) of an i-th scanned wire is denoted as TGi. The time gain TGi corresponds to the ratio of the cycle of a virtual fixed reference clock signal PCLK' in a normal drive mode wherein the scanned wire selection time is not changed to the cycle of the reference clock signal PCLK in this embodiment. If the cycle of the reference clock signal PCLK in this embodiment is changed ½-fold, then the time gain TGi will be 2. A second multiplication coefficient (data gain) corresponding to the i-th scanned line is denoted as DGi.

Furthermore, the upper limit value of the input data of a modulator in the drive circuit 7 is denoted as DataMAX, and the reference selection time in the normal drive mode, wherein the selection time of scanned lines is not changed, is denoted as H. One-frame time during which display is implemented is denoted as Tv. The one-frame time Tv for carrying out display is preferably the same as the frame time of an image signal normally input.

When the display luminance increasing rate for each frame is denoted as GAIN, the timing controller 10 calculates TGi and DGi such that GAIN≧1 and a largest possible GAIN, while expression 1) through expression 3) shown below hold true. This calculation processing may be carried out by a fast CPU or hardware for acquiring, for example, proximity solutions.

$$TGi \times DGi = GAIN \text{ (Holds for any } i\text{)} \quad \text{Expression 1)}$$

$$MDi \times DGi \leqq DataMAX \text{ (Holds for any } i\text{)} \quad \text{Expression 2)}$$

$$\Sigma((1/TGi) \times H) \leqq Tv \quad \text{Expression 3)}$$

The timing controller 10 defines the cycle of the reference clock signal PCLK as 1/(TGi) and outputs 1/(TGi), and outputs DGi as a second multiplication coefficient to be used by the data multiplier 30.

Thus, the selection time for each scanned wire can be allocated on the basis of received image data, namely, luminance data S3.

Some solutions that satisfy the conditions of expressions 1) through 3) provide an extremely large GAIN, depending on the received luminance data S3. This happens if, for example, an entire image is dark. In this case, the image that is originally dark is displayed as a brighter image. Preferably, therefore, an upper limit value is established for GAIN.

In addition, an upper limit of the time gain TGi should be set to secure the shift transfer time for sending luminance data to the aforementioned shift register 5 and to set the upper limit of the frequency of the reference clock signal PCLK. For instance, setting the upper limit of the time gain TGi to 2 will double the operating frequency. The actual upper limit should be determined from the upper limit value of the operating frequency of the devices to be used.

The display luminance increasing rate GAIN may vary from one frame to another, and a great variation in GAIN may cause screen luminance to vary from one frame to another, resulting in flickering. To avoid this problem, the calculation is preferably performed so as to allow a gentle change for a scene with continuous GAIN and also to accommodate a sudden change at a scene change. This should provide a better result than an animated image.

Furthermore, the time slots that can be modulated in one frame are divided by the total numbers of time slots determined by Mdi of each scanned line to determine GAIN. This will permit minimized efforts for carrying out the computation of expressions 1) through 3).

The fourth embodiment makes it possible to improve the display luminance of images with lower average picture levels (APL) as in natural images, and also to improve contrast by reducing black level luminance over the conventional drive method with fixed selection time.

Obviously, the allocation of selection time, i.e., the method for generating KHD, PCLK and the coefficients of the data multiplier can be applied to the second and third embodiments in the same manner.

This embodiment is provided with the compensating circuit 30 for carrying out signal processing to compensate for a deviation in the luminance of pixels in a selection period from a desired value on the basis of the length of the selection period and/or the cycle of a reference clock signal. This feature allows, for example, the aforesaid GAIN to be determined from Mfx/Mf, where the number of unit waveforms determined on the basis of the maximum value of pixel data for each selected row is denoted by Mh, the total number of Mh's over a plurality of selection periods is denoted by Mf, the total number of displayable unit waveforms over a plurality of selection periods is denoted as Mfx, and the multiplication coefficient for multiplying the pixel data therewith, as necessary, is denoted by GAIN.

Modifying the construction of the modulator of the drive circuit shown in FIG. 12 makes it possible to achieve a drive control method for a matrix panel using the modulation method described in the second or third embodiment by adopting the configuration shown in FIG. 12.

As a modulator used for the above modulation method, a modulator similar to the one disclosed in European Unexamined Patent Application Publication No. 1267319 may be used.

Especially when the third embodiment is to be implemented using the configuration shown in FIG. 12, a power circuit (17) for supplying at least three levels of modulation reference voltages (V1, V2, V3 and GND) that can be selected on the basis of pixel data to the column drive circuit 7. The modulator of the column drive circuit 7 should be configured to provide a period during which pulse width modulation using the first modulation reference voltage V1 is performed for a first modulation range (slots 1 through 8) and a period during which pulse width modulation using the second modulation reference voltage V2, which is higher than the first modulation reference voltage, is performed for a second modulation range (slots 9 through 14) of higher luminance levels. With this arrangement, the current passing through the matrix wires or anodes is dispersed in the temporal direction during a selection period, thus restraining the concentration of current. In the case of such complex modulation signals, the cycle of the reference clock signal PCLK is changed to determine the selection period, permitting easy change of the selection period on the basis of data.

OTHER EMBODIMENTS

In the description of the present invention, the maximum value MDi of luminance data has been determined from the group of luminance data to be displayed by a plurality of pixels for each scanned line, i.e., each selected row. Alternatively, however, a value of, for example, 95% of a determined maximum value may be handled as MDi of luminance data. This permits further brighter display to be achieved. In this case, the selection period will be shorter than that for the luminance data exceeding 98% of the maximum value; therefore, it is preferred to add a limiter circuit (not shown) following the data multiplier 30 so as to subject the luminance data to the limiter. This will slightly suppress peak luminance, but allow bright display at the remaining gray scales, thus providing an effective drive control method for a matrix panel with low luminance.

The second and third embodiments have described drive examples wherein the modulation signal waveform voltages are stacked in steps at rise and fall. Alternatively, however, a modulation waveform may be formed of a simple stack without such steps, e.g., a stack of the unit waveform 9 over the unit waveform 1 shown in FIG. 9. Such a waveform is shown in, for example, Japanese Unexamined Patent Application Publication No. 7-181917.

The upper limits and lower limits of the variable ranges in which selection periods and clock signal cycles are selected are not limited to any particular values; they are appropriately set primarily on the basis of frame frequencies or the number of rows or columns.

The pixels used in the present invention are not restricted to ones emitting visible light; they may be pixels that discharge electron beams. More specifically, the pixels used in the present invention are not limited to cold cathode devices or electron-emitting display devices that combine cold cathode devices and fluorescent materials; they also may be applied to organic EL (electro-luminescent) devices, inorganic EL devices, organic LEDs (light-emission diodes), inorganic LEDs, and the like. The cold cathode devices are not limited to the surface-conductive electron emitting devices; Spint cold cathode devices or electric-field emitting cold cathode devices using carbon fibers, such as CNT (carbon nano-tube) or GNF (graphite nano-fiber), as their electron emitters may be used, or MIM (metal-insulator-metal) type emitting devices may be used.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A matrix panel drive control apparatus comprising:

a row selection circuit for selecting at least one row from among a plurality of rows of the matrix panel during a selection period;

a column drive circuit for supplying a modulation signal based on pixel data to a plurality of columns of the matrix panel in synchronization with the selection period;

a clock signal supplying circuit for supplying a reference clock signal for controlling at least a pulse width of the modulation signal to the column drive circuit; and a control circuit for setting, for each selected row, a length of the selection period and a cycle of the reference clock signal on the basis of the pixel data of that row, the setting making it possible to satisfy both of the following conditions: (a) a cycle of the reference clock signal for the first row is longer than a cycle of the reference clock signal for the second row and (b) the selection period of the first row is longer than a selection period of the second row.

2. The matrix panel drive control apparatus according to claim 1, further comprising a power circuit for supplying to the column drive circuit at least three levels of modulation reference voltages that can be selected according to the pixel data, wherein pulse width modulation based on the reference voltage for first modulation is performed in a first modulation range, and pulse width modulation based on the reference voltage for second modulation, which is higher than the reference voltage for the first modulation, is performed in a second modulation range having a higher luminance level.

3. The matrix panel drive control apparatus according to claim 2, wherein the selection period and the cycle of the reference clock signal are selected in a variable range for each selected row on the basis of a maximum value of the pixel data of each selected row.

4. The matrix panel drive control apparatus according to claim 1, wherein the selection period and the cycle of the reference clock signal are selected in a variable range for each selected row on the basis of a maximum value of the pixel data of each selected row.

5. The matrix panel drive control apparatus according to claim 4, wherein if the number of unit waveforms that depends on the maximum value of the pixel data for each selected row is denoted by Mh, the total number of the Mht's over a plurality of selection periods is denoted by Mf, the total number of displayable unit waveforms over the plurality of selection periods is denoted by Mfx, and the multiplication coefficient for multiplying the pixel data therewith, as necessary, is denoted by GAIN, then the GAIN is determined by Mfx/Mf.

6. The matrix panel drive control apparatus according to claim 1, further comprising a compensating circuit for carrying out signal processing to compensate for the deviation of the luminance of a pixel from a desired value in a selection period on the basis of the length of the selection period and/or the cycle of the reference clock.

7. The matrix panel drive control apparatus according to claim 6, wherein if the number of unit waveforms that depends on the maximum value of the pixel data for each selected row is denoted by Mh, the total number of the Mh's over a plurality of selection periods is denoted by Mf, the total number of displayable unit waveforms over the plurality of selection periods is denoted by Mfx, and the multiplication coefficient for multiplying the pixel data therewith, as necessary, is denoted by GAIN, then the GAIN is determined by Mfx/Mf.

8. A matrix panel drive control method comprising:

a row selection step for selecting at least one row from among a plurality of rows of a matrix panel during a selection period;

a column drive step for supplying a modulation signal based on pixel data to a plurality of columns of the matrix panel in synchronization with the selection period;

a clock signal supplying step for supplying a reference clock signal for controlling at least a pulse width of the modulation signal to the column drive circuit; and a setting step for setting, for each selected row, a length of the selection period and a cycle of the reference clock signal on the basis of the pixel data of that row, the setting making it possible to satisfy both of the following conditions: (a) a cycle of the reference clock signal for the first row is longer than a cycle of the reference clock signal for the second row and (b) the selection period of the first row is longer than a selection period of the second row.

* * * * *

UNITED STATES PATENT AND TRADEMARK OFFICE

CERTIFICATE OF CORRECTION

PATENT NO. : 7,277,105 B2
APPLICATION NO. : 10/747266
DATED : October 2, 2007
INVENTOR(S) : Naoto Abe et al.

It is certified that error appears in the above-identified patent and that said Letters Patent is hereby corrected as shown below:

COLUMN 17:
Line 24, "Mht's" should read -- Mh's --.

Signed and Sealed this

Tenth Day of June, 2008

JON W. DUDAS
*Director of the United States Patent and Trademark Office*